US006936314B1

(12) United States Patent
Schultz

(10) Patent No.: US 6,936,314 B1
(45) Date of Patent: Aug. 30, 2005

(54) THREE-DIMENSIONAL ARTIFICIAL TREE

(76) Inventor: Paul Schultz, 2970 N. Sheridan, #926, Chicago, IL (US) 60657

( * ) Notice: Subject to any disclaimer, the term of this patent is extended or adjusted under 35 U.S.C. 154(b) by 52 days.

(21) Appl. No.: 10/370,896

(22) Filed: Feb. 18, 2003

(51) Int. Cl.[7] ..... A41G 1/00

(52) U.S. Cl. ..... 428/18; 428/7; 428/9; 428/542.6

(58) Field of Search ..... 428/7, 9, 542.6, 428/18

(56) References Cited

U.S. PATENT DOCUMENTS

| | | | | |
|---|---|---|---|---|
| 1,162,230 | A | | 11/1915 | Foster |
| 2,731,752 | A | | 1/1956 | Erickson et al. |
| 3,176,123 | A | | 3/1965 | Blake |
| 3,677,867 | A | | 7/1972 | Westlund |
| 4,145,731 | A | | 3/1979 | Adamich |
| 4,331,720 | A | | 5/1982 | Vin Dick et al. |
| 4,332,095 | A | * | 6/1982 | Tanney ..... 40/771 |
| 4,517,251 | A | * | 5/1985 | Mosely ..... 428/542.8 |
| 4,746,022 | A | | 5/1988 | Benham |
| 5,336,536 | A | | 8/1994 | Oberzan |
| 5,405,662 | A | | 4/1995 | Oberzan |
| D408,319 | S | | 4/1999 | Byers |
| 6,048,590 | A | | 4/2000 | Phillips |
| 6,132,063 | A | | 10/2000 | Byers |
| 6,139,168 | A | | 10/2000 | Gary et al. |
| 6,200,656 | B1 | | 3/2001 | Tsang |
| D442,115 | S | | 5/2001 | Tsang |

* cited by examiner

*Primary Examiner*—Terrell Morris
*Assistant Examiner*—Arden B. Sperty
(74) *Attorney, Agent, or Firm*—Howard B. Rockman; Barnes & Thornburg LLP

(57) ABSTRACT

An expandable tree-shaped device is formed from a sheet of material which includes a central apex and a plurality of spaced apart spiral strips extending therefrom, with the spiral strips being substantially coaxial to the central apex and to one another. The central apex and the spiral strips, in the operative position, are positioned in a vertically spaced, tiered array, with the central apex at an uppermost position such that the tiered array is configured to have a generally conical tree-shape. A plurality of connecting segments join each spiral strip or tier of the array to a next adjacent spiral strip or tier of the array to form a unitary structure. The width of each spiral strip increases proportionately with the increase in radial distance from the central point.

16 Claims, 5 Drawing Sheets

THREE-DIMENSIONAL ARTIFICIAL TREE

BACKGROUND OF THE INVENTION

The present invention relates to an artificial tree, such as an artificial coniferous or Christmas tree, which is easy to assemble and disassemble, and when disassembled occupies a small amount of space which facilitates storage.

Artificial trees, such as artificial evergreens or Christmas trees, have been known for many years and have been formed in various manners. In particular, such artificial trees are known to be formed from a number of natural and synthetic materials to provide individual branches, which may be removably mounted to a central pole resembling a tree trunk. These known trees are thus disassembled by removing the branches or collapsed by folding the branches. However, such known trees are often difficult to assemble and disassemble, or assembly and disassembly is time consuming, and/or the disassembled condition of the tree occupies a large amount of space making storage difficult and costly.

Artificial trees have also been designed, such as disclosed in U.S. Pat. No. 6,139,168, that incorporate three spaced-apart spiral strips having connecting strips at spaced-apart intervals to interconnect the spiral strips and form a unitary structure. However, such known artificial trees often require additional support structure, such as a central pole or trunk, to assemble and display the tree. Additionally, although the assembled structures give a tree-like impression, the uniform dimensions of the spirals and placement of connectors does not create a "natural" appearance of a tree.

In nature, growth occurs in geometric proportionate ways, or patterns. There has been a substantial amount of research directed toward the natural phenomenon associated with growth patterns. The natural growth patterns have been associated or interconnected with mathematical expressions or constants, such as the Fibonacci Sequence (0,1,1,2,3,5, 8,13 . . . ) and the Golden Mean (1.618 . . . ), which in turn is related mathematically to geometries such as pentagrams and the Golden Rectangle (W =1, L =1.618 . . . ) or Golden Triangle. These relationships of natural growth are ultimately expressed in the spiral shape. This relationship of the spiral to natural growth is easily seen in the shape of the nautilus shell, the arrangement of sunflower seeds in the sunflower, in the bracts of pinecones and curls of ferns, among other various natural phenomena. In natural growth, there is no simpler law than this, namely that it shall widen and lengthen in the same unvarying proportions. The shell, like the creature within it, grows in size but does not change its shape; and the existence of this constant relativity of growth, or constant similarity of form is the essence of the spiral. A spiral is a curve on a plane that winds around a fixed center point at a continuously increasing or decreasing distance from the point.

Botanists have shown that plants grow from a single tiny group of cells right at the tip of any growing plant, called the meristem. There is a separate meristem at the end of each branch or twig where new cells are formed. Once formed, they grow in size, but new cells are only formed at such growing points. Cells earlier down the stem expand and so the growing point rises. Thus the lower (older) branches of a plant, such as a tree, are larger than the higher (newer) branches.

The prior art expandable trees do not follow the principle of geometric growth and therefore, their lower branches (portion of the spiraling strips nearer the lower end), which are of equal width to the higher branches (portion of the spiraling strip nearer the central axis) do not assume a "natural" tree-like appearance.

It is an object of the present invention to provide an artificial tree, which may symbolically represent a coniferous or Christmas tree and which is quickly and easily assembled to assume a "natural" appearance of natural growth.

SUMMARY OF THE INVENTION

Accordingly, the present invention relates to a relatively problem-free, readily assembled artificial tree such as a Christmas tree. The artificial tree of the present invention can be quickly assembled, often in as little time as a few moments, and can be equally quickly disassembled. Furthermore, upon disassembly, the artificial tree of the present invention occupies a relatively compact space, which is significantly smaller than previously known artificial trees. Thus, the artificial tree of the present invention is also easy to store.

In accordance with the present invention, an expandable tree element or tree-shaped device is formed from a unitary sheet of material which includes a central apex and a plurality of spaced apart spiral strips extending therefrom, with the spiral strips being substantially coaxial to the central apex and to one another. The central apex and the spiral strips, in the operative position, are positioned in a vertically spaced, tiered array, with the central apex at an uppermost position such that the tiered array is configured to have a generally conical tree-shape. A plurality of connecting segments join each spiral strip or tier of the array to a next adjacent spiral strip or tier of the array to form a unitary structure. The width of each spiral strip increases proportionately with the increase in radial distance from the central point. Optionally, the width and/or the length of the connecting segments may also increase proportionately with the radial distance from the center point. The plurality of spaced apart spiral strips are defined by forming a plurality of slit arrays in the sheet of material. Each slit array comprises a plurality of radially spaced, discontinuous, annularly overlapping slits. The positioning of the slits determines the shape and dimensions of the spiral strips and connecting segments.

BRIEF DESCRIPTION OF THE DRAWINGS

The above and other features and advantages of the present invention will become apparent from the following description of the preferred embodiments, given as non-limiting examples, with reference to the accompanying drawings, in which.

DETAILED DESCRIPTION OF THE PREFERRED EMBODIMENTS

Figure 1:
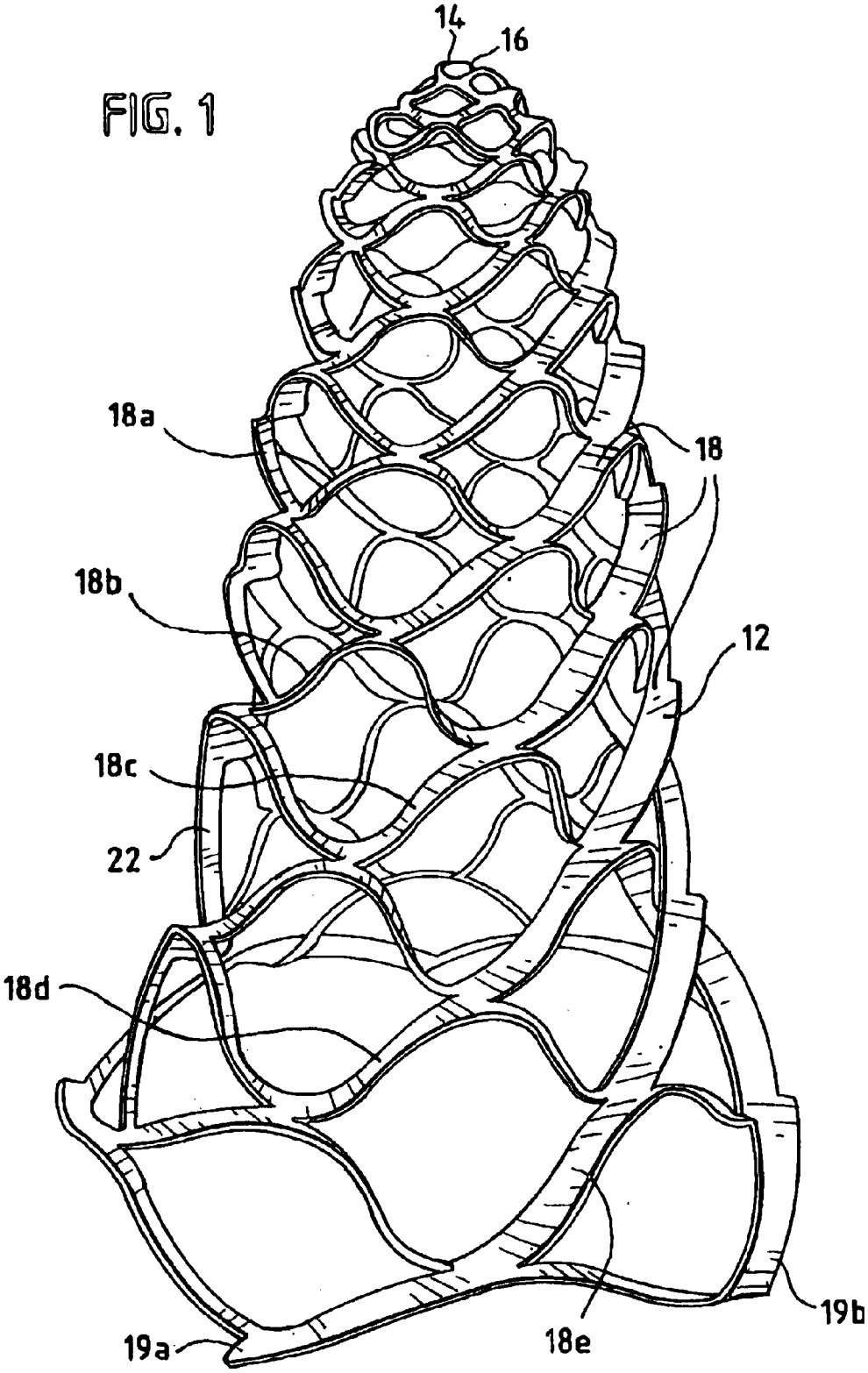
FIG. 1 is a front perspective view of an artificial tree according to a first embodiment of the present invention.
Figure 2:
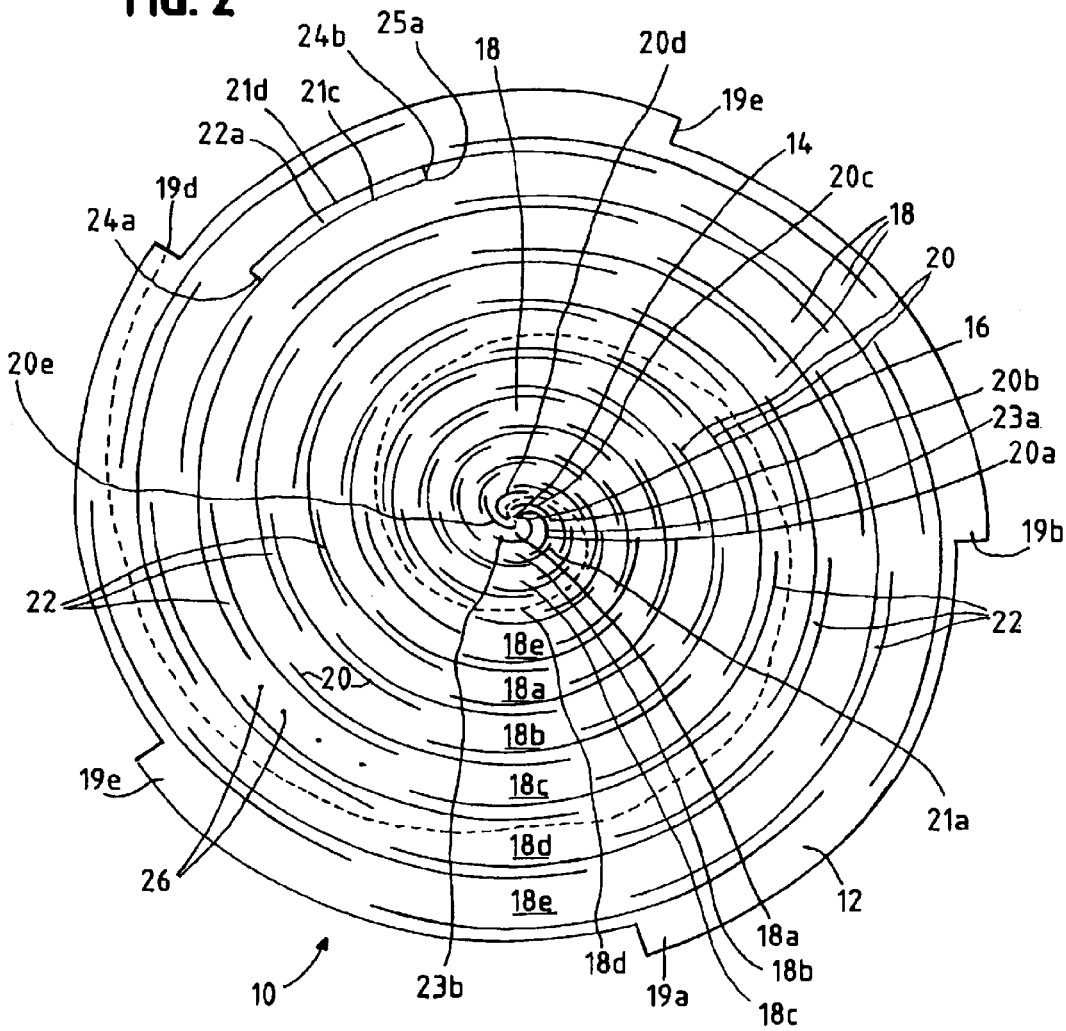
FIG. 2 is a top plan view of the first embodiment of the present invention in a lay-flat presentation.

Referring to FIGS. 1–4, an artificial tree according to the present invention, generally identified by the numeral 10, includes a base member or sheet 12 from which the tree is formed. Reference numerals will remain constant for like elements throughout the figures. FIG. 2 illustrates base sheet 12 in a lay-flat position. The base member or sheet 12 includes a central apex or point 14, which defines a generally central position of the sheet 12, and ultimately a top of the tree 10. The central point 14 preferably includes a means or fastening element for suspending the central point 14 in a vertically elevated position, such as an aperture 16 which is operable to receive a string or other suitable means for suspending the tree 10 from an elevated structure. By suspending the tree 10 from an elevated position, the tree 10 is configured by gravity in its expanded, tree-like position as shown in FIG. 1.

Figure 3:
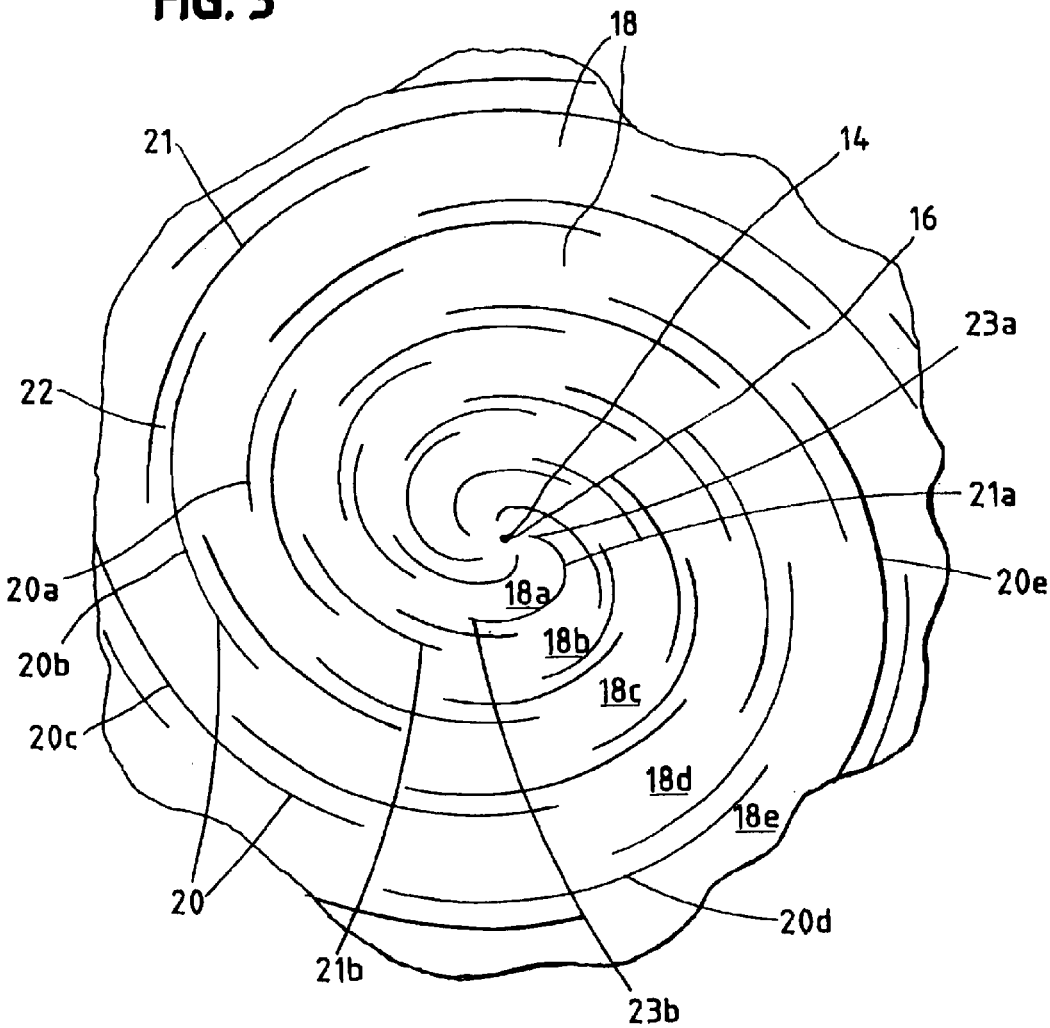
FIG. 3 is an enlarged, cut-away top plan view of a portion of the first embodiment illustrated in FIG. 2.
Figure 4:
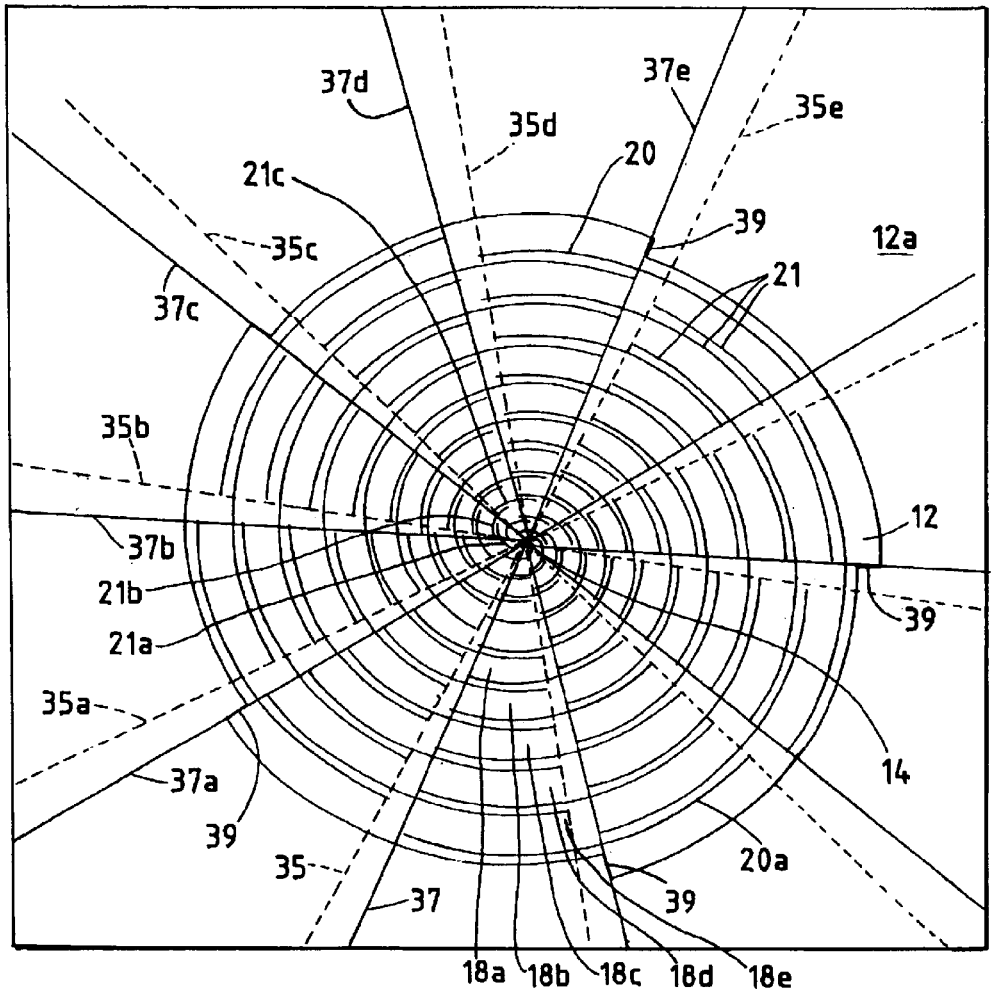
FIG. 4 is a top plan view of a material blank depicting the design layout for forming an artificial tree in accordance with the present invention.

The tree 10 is provided with a plurality of spaced apart, continuous spiral strips 18 that "grow" or extend from the central point 14. In a preferred embodiment, such as that shown in FIGS. 1–4, the tree 10 includes five (5) spirals 18*a–e* that grow or extend from the central point 14. As best shown in FIGS. 2–4, the sheet 12 is provided with a plurality of spiral slit arrays 20 with each slit array 20 comprising a plurality of radially spaced, discontinuous, annularly overlapping slits 21 that define the continuous spiral strips 18*a–e*. The preferred embodiment includes five (5) slit arrays 20*a*–e to form the five (5) spiral strips 18*a–e* having ends 19*a–e*. The slits 21 that form each slit array 20 may be straight, although curvilinear slits are preferred as shown in FIGS. 2–4. As illustrated in FIG. 3, each slit array 20 includes a first slit 21*a* including a first end 23*a* and second end 23*b*. First end 23*a* is spaced from the central point 14 and the first slit 21*a* extends outwardly in a curvilinear fashion such that second end 23*b* is spaced a greater distance from the central point 14 than the first end 23*a* and terminates in a different annular position than the first end 23*a*. A second slit 21*b* of each array is spaced radially outward of the second end 23*b* and continues in the proportionately outward growth pattern as established by the first slit 21*a*, but in a partially annularly overlapping arrangement. In the preferred embodiment, the amount of annular overlap increases proportionately with the increase in width of spiral strips as discussed below. Each slit array 20*a–e* is annularly offset from adjacent slit arrays at equal intervals around the center point 14 and follow the same growth pattern.

In order to give the tree 10 a more "natural" appearance, the width of each of the continuous spiral strips 18 continuously increases proportionately with the radial distance from the central point 14. In other words, the width of a spiral strip is greater than the width of an inner next adjacent spiral strip, measured along the same radial line from the center point 14, and is less than the width of an outer next adjacent spiral strip measured along the same radial line.

The tree 10 includes a plurality of connecting segments 22, which form continuous bridges between adjacent spiral strips 18. When the tree 10 is expanded vertically, the connecting segments 22 interconnect the plurality of spiral strips in a unitary structure. The connecting segments 22 are formed by the radial spacing and annular overlapping of slits 21 in each slit array 20. The particular number of slits 21 used to define each slit array 20 may be selected to be any number, but it should be noted that the length of the slits 21 and the amount of annular overlap between the slits 21 in each array 20 determines the length of the connecting segment 22 and hence the spacing between the spiral strips 18*a–e* as seen in FIG. 1. In order to provide a more "natural" appearance of the tree 10, the annular overlap of the slits 21 in each array 20 may be increased proportionately as the radial distance from the central point 14 increases, to increase the length of the connecting segments 22. Thus, the vertical spacing between spiral strips 18, when the tree 10 is configured in its expanded form, increases the further the spiral strip 18 extends from the central point 14. This ensures that the lower "branches" of the tree 10 have greater spacing than the upper "branches" as occurs in nature. Also, the radial spacing of the slits 21 within the same array 20 may increase proportionately as with the spiral strips 18 discussed above. This provides for an increasing width of the connecting segments 22 proportionate to the increasing width of the spiral strips 18*a–e*.

The base sheet 12 may be formed from any material with suitable structural characteristics that allow for expansion of the tree 10, such as paper, plastics, chipboard, cardboard, metals and composites or laminates of the foregoing, so long as the material is able to be cut, scored, creased and/or bent. Preferably, the sheet 12 is a plastic material. Plastic materials are preferred for their wide variety of structural and light absorbing/reflecting characteristics, as well as their economic qualities. If more rigid materials are used, such as chipboard or metal sheeting, it may be necessary to bend, crease, score or otherwise provide a line of weakness in portions of the sheet 12 such that the material is induced to pivot at predetermined locations when the tree 10 is hung by the central point 14. For example, if copper sheeting is used, it may be necessary to provide a weakened area or score 24*a* (FIG. 2) in the material extending radially between an outward end of each slit to the outwardly next adjacent slit, and a score 24*b* extending radially between the inner slit and the outwardly next adjacent slit. Thus, the ends of connecting segment 22*a* are both scored such that during the raising of the tree 10, the gravitational forces are directed to act on the predetermined scores, causing the copper sheeting to pivot or bend in the predetermined position and reducing the risk of unwanted creasing within the length connecting segment 22*a*.

The material forming the sheet 12 is preferably die-cut to form the radially spaced, annularly overlapping slits 21, such as shown in FIG. 3. However, the slits 21 may be formed in any known manner, such as by cutting, sawing, or by the use of a laser cutting apparatus. Preferably, the aperture 16 is also cut at the central point 14. The aperture 16 allows for the easy attachment of an elongate flexible member, such as a wire or string, or other structure that allows the tree 10 to be hung and thereby expand the tree 10. If an aperture is not provided, the user may simply thread wire or string through the five innermost slits 21 to suitably secure the tree 10. Optionally, the tree 10 may be draped over a central pole (not shown) that supports the tree 10 at the central point 14.

During the die-cutting or forming step, a plurality of mounting apertures 26 may be provided within each spiral strip 18*a–e* to provide a point of attachment and suspension of lighting strips or traditional tree ornaments. Optionally, the surface of the sheet 12 may be provided with ornamentation in the form of printed graphics and/or topography. For example, a plastic sheet may be vacuum formed to provide a pine needle-like surface that resembles a natural tree and which adds additional light scattering characteristics to the tree 10.

When hung from or supported at the central point 14, the force of gravity operates to expand the tree 10. The connecting segments 22 provide for a predetermined spacing between each spiral strip 18 to form a unitary coniferous, or Christmas tree-like device. Preferably, the tree 10 is suspended completely above the floor or other surface such that the tree 10 may expand and contract, or rise and fall, as well as rotate about the central point 14 due to natural or artificial air circulation. Optionally, the spiral strip ends 19*a–e* may be secured to a surface or otherwise weighted to prevent such movement. The tree 10 may be illuminated with natural or artificial light sources from above, below, on (as discussed above) or within. The choice of material for the sheet 12 will determine from which source and from which direction the tree 10 is best illuminated.

While the above-mentioned features and advantages of this invention and the manner of obtaining them may be apparent to understand the method of producing an artificial tree according to the present invention, the inventive method of manufacturing an artificial tree, itself, may best be understood by reference to the following description taken in conjunction with the above identified features.

Referring to FIG. 4 of the drawings, a blank of material 12*a* from which the base sheet 12 is cut is shown. The blank 12*a* which is used to form the tree or tree-shaped device of the present invention may comprise any desirable shape, such as a thin rectangular sheet material, preferably plastic. The base sheet 12 can have any suitable size, and in a preferred embodiment, provides for a circular disc having a diameter of about 48 inches to be cut from the base sheet.

As can be seen from FIG. 4, the base sheet 12 includes a central point 14, which is established to be the focal point from which the remaining parts are defined. Two sets of radial guidelines 35 and 37 are overlaid on the base sheet 32. Each set of radial guidelines 35 and 37 includes five lines 35*a–e* and 37*a–e* respectively. Each of the lines 35*a–e* and 37*a–e* passes through and intersects at the center point 34. The lines 35*a–e* and 37*a–e* are annularly offset an equal amount within each set of radial guidelines 35 and 37, preferably thirty-six degrees. The two sets of radial guidelines 35 and 37 are, in turn, offset annularly, preferably five to ten degrees. The radial guidelines 35 and 37 determine the beginning and end of slits 21 provided in the sheet 12.

As can be seen from FIG. 4, there are five (5) spiral slit arrays 20 extending from the center point 14. One spiral slit array 20*a* is shown darker in FIG. 4 for illustration purposes. Each spiral slit array 20 includes a number of curvilinear slits 21 made through the material of the blank 12*a*. As best shown with respect to slit array 20*a*, a first slit 21*a* begins on line 35*a* and extends in a generally curvilinear manner with its distance from the central point 14 increasing proportionately with the annular distance traveled. The first slit 21*a* terminates at line 37*c*. A second slit 21*b* is spaced radially outwardly from the first slit 21*a* and extends from line 35*b* in a generally curvilinear manner and terminates at line 37*d*. A third slit 21*c* is spaced radially outwardly from the second slit 21*b* and extends from line 35*c* in a generally curvilinear manner and terminates at line 37*e*. This pattern continues until the spiral slit array 20*a* extends to the outer perimeter desired for the tree. Every slit 21 in a spiral slit array 20 is proportionately longer as the radial distance from the center point 14 increases. Preferably, the radial spacing between each slit 21 in the array 20 also increases as the radial distance from the center point 14 increases. An end slit 39 is provided between the outward end of the last slit 21 of each slit array 20 and the inner end of the last slit 21 of each inner next adjacent slit array 20 to fully separate the base sheet 12 from the blank 12*a*.

Figure 5:
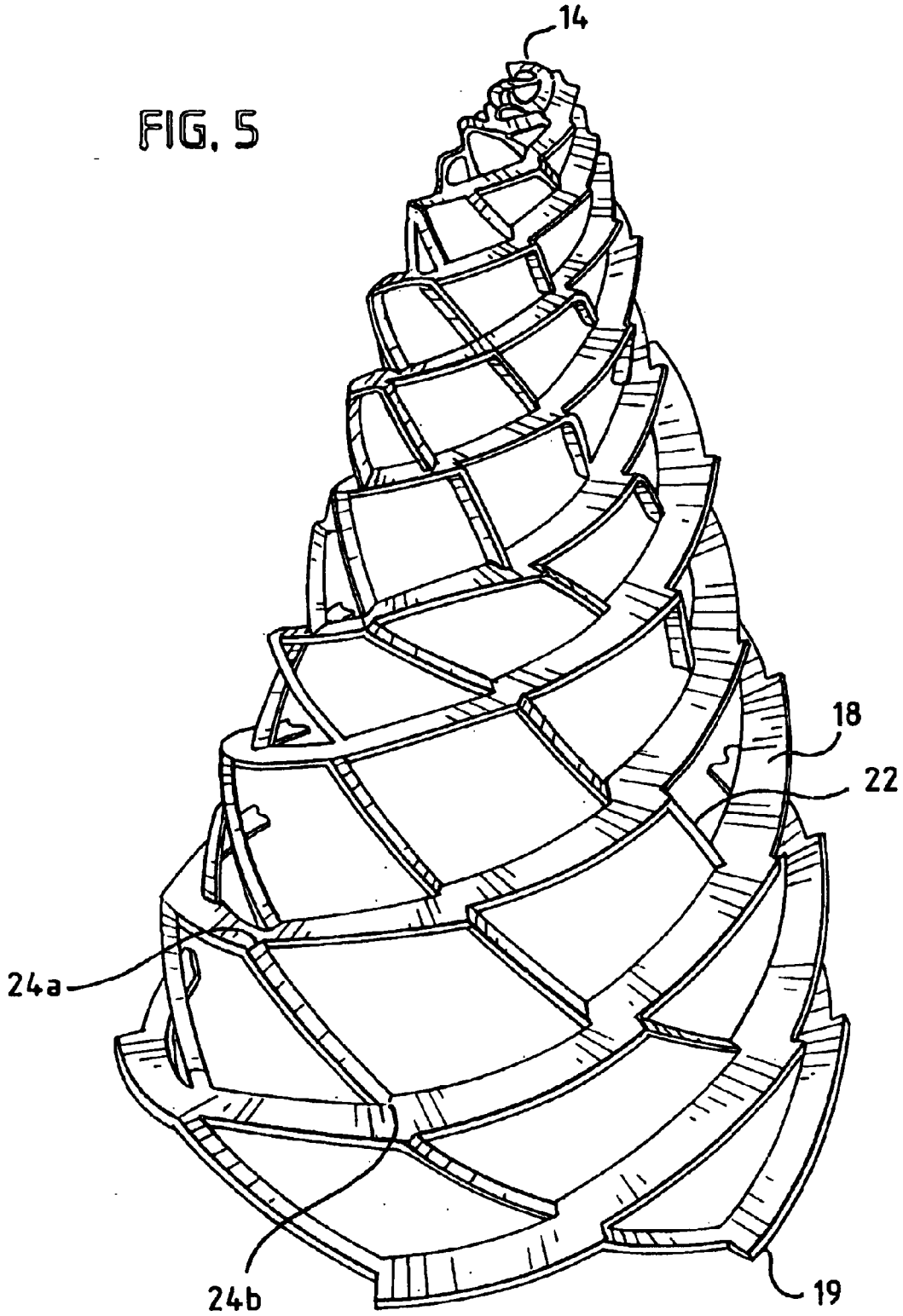
FIG. 5 is a front perspective view of an artificial tree formed from a material including score lines between connecting segments and spiral strips.

The base sheet 12 is preferably die-cut according to the above design and provided with an aperture 16 or other suitable means that allows for the suspension of the tree, located at the central point 14. A wire, string or other suitable means for suspending the tree is attached at the central point 14 and further attached to an elevated surface, e.g.: a ceiling beam, such that gravity acts to expand the tree to the configurations shown in FIGS. 1 and 5.

Accordingly, the artificial tree of the present invention as set forth above can be quickly assembled, often in as little time as just a few moments, by simply pulling the disc-shaped base member upwardly to form the vertically spaced tiered array, and hanging the tree from the central point 14. Since the bottom portion of the tree 10 comprises radially larger members, gravity holds the tree in its extended position. When the tree is no longer needed for display, the tree can be readily disassembled by merely reversing the assembly operations. Furthermore, upon disassembly, it can be seen that due to the collapsibility of the base member into a generally sheet form, the disassembled artificial tree of the present invention occupies a relatively compact space. Thus, the artificial tree of the present invention is also easy to store.

Although the above invention has been described with particular means, materials and embodiments, it is to be understood that the invention is not limited to the particulars disclosed and extends to all equivalents within the scope of the claims.

What is claimed is:

1. An expandable tree-like device formed from a sheet member comprising:

a) a plurality of continuous spiral strips extending from a central point, each of said plurality of spiral strips having a width increasing proportionately with respect to the radial distance from said central point; and, b) a plurality of connecting segments connecting each spiral strip to a next adjacent spiral strip; and, c) wherein said plurality of spiral strips and said plurality of connecting segments are defined by a plurality of slit arrays.

2. The expandable tree-like device of claim 1, wherein the length of each connecting segment increases proportionately with the radial distance from said central point.

3. The expandable tree-like device of claim 1, wherein the center point includes a fastening element for suspending said tree-like device such that gravity causes said device to expand into a unitary tiered array.

4. The expandable tree-like device of claim 3, wherein said fastening element for suspending said tree-like device comprises an aperture operable to receive an elongate flexible member.

5. The expandable tree-like device of claim 1, wherein said plurality of spaced apart, continuous spiral strips and said plurality of connecting segments are firmed from a unitary sheet of material.

6. The expandable tree-like device of claim 5, wherein said unitary sheet of material is selected from the group consisting of plastic, metal, paper, wood, glass, rubber, chipboard, cardboard and combinations of the foregoing.

7. The expandable tree-like device of claim 5, wherein said unitary sheet of material comprises a plastic sheet.

8. The expandable tree-like device of claim 1, wherein at least one of said plurality of spiral strips includes a plurality of mounting apertures.

9. The expandable tree-like device of claim 8, wherein said plurality of mounting apertures are operable to receive and suspend ornaments.

10. The expandable tree-like device of claim 1, wherein said plurality of spiral strips comprise five spiral strips.

11. The expandable tree-like device of claim 1 wherein each of said plurality of slit arrays comprises a series of radially spaced and annularly overlapping, discontinuous slits formed between said center point and a next adjacent spiral strip to define an inner and outer perimeter of each of said spiral strips.

12. The expandable tree like device of claim 11, wherein the radial spacing between overlapping slits in each slit array increases proportionately with the radial distance from said central point such that the width of each connecting segment is greater than the width of each connecting segment radially inward thereof.

13. The expandable tree-like device of claim 11, including a line of weakness disposed radially between the outward end of each slit and the outwardly next adjacent slit of the same slit array.

14. The expandable tree-like device of claim 13, wherein said line of weakness is selected from a score line and a crease in the material.

15. A method of making a unitary expandable tree-like device, comprising:

a) providing a sheet of material;

b) locating a center point on said sheet of material;

c) providing said sheet of material with a plurality of slit arrays, said slit arrays comprising a series of radially outward spaced and annularly overlapping, discontinuous slits between said center point and the outer perimeter of said sheet of material, said plurality of slit arrays defining a plurality of continuous spiral strips and a plurality of connecting segments connecting adjacent spiral strips, wherein the radial spacing of each of said slit arrays increases proportionately with respect to the radial distance from said center point such that the width of each of said spiral strips increases as the radial distance of the spiral strip from said center point increases.

16. A method as in claim 15, wherein said overlapping of said slits of each said slit array increases proportional to the radial distance from said center point such that the length of said connecting segments increases proportionately with the radial distance from said center point.

* * * * *